US006100753A

United States Patent [19]

Lee et al.

[11] Patent Number: 6,100,753

[45] Date of Patent: Aug. 8, 2000

[54] BIAS STABILIZATION CIRCUIT

[75] Inventors: Chang Seok Lee, Dejon-Shi; Min Gun Kim, Daejon-Shi; Jae Jin Lee, Daejon-Shi; Kwang Eui Pyun, Daejon-Shi, all of Rep. of Korea

[73] Assignee: Electronics and Telecommunications Research Institute, Daejon-Shi, Rep. of Korea

[21] Appl. No.: 09/137,886

[22] Filed: Aug. 21, 1998

[30] Foreign Application Priority Data

Dec. 6, 1997 [KR] Rep. of Korea ..... 97-66546

[51] Int. Cl.[7] ..... G05F 1/10

[52] U.S. Cl. ..... 327/538; 327/540

[58] Field of Search ..... 327/538, 540, 327/541, 543; 330/277, 296

[56] References Cited

U.S. PATENT DOCUMENTS 5,506,544 4/1996 Staudinger et al. ..... 330/277

5,633,610 5/1997 Maekawa et al. ..... 327/355

*Primary Examiner*—Jeffrey Zweizig

*Attorney, Agent, or Firm*—Cohen, Pontani, Lieberman & Pavane

[57] ABSTRACT

The present invention relates to a bias stabilization circuit, specifically to a bias stabilization circuit for minimizing the current variations of amplification transistors caused by variations of device parameters which occur during the manufacturing of high-frequency integrated circuits using field-effect transistors, and caused by variations of supply voltage and temperature. In the present invention, the above problem is solved by configuring a level shifter circuit between the drain node and the gate node of the reference voltage generation transistor. Further, by using a constant current source utilizing a depletion transistor and series feedback resistors as a reference current, this circuit becomes stable against the variations of the device parameters as well as the variations of the temperature and supply voltage.

1 Claim, 2 Drawing Sheets

BIAS STABILIZATION CIRCUIT

BACKGROUND OF THE INVENTION

1. Field of the Invention

The present invention relates to a bias stabilization circuit, specifically to a bias stabilization circuit for minimizing the current variations of amplification transistors caused by variations of device parameters which occur during the manufacturing of high-frequency integrated circuits using field-effect transistors, and caused by variations of supply voltage and temperature.

2. Art Background

In high-frequency integrated circuits which utilize field-effect transistors, a bias stabilization circuit which maintains current stable is indispensable because high-frequency small-signal characteristics of field-effect transistors are determined largely by the current. Thus, many bias stabilization circuits which make drain currents stable have been proposed and used to minimize the current variation due to not only the variations of device characteristics which occur during manufacturing process, but also the variations of device characteristics due to the variations of operating temperature. Three of them are most representative methods which we will describe here referring to the figures.

FIGS. 1 to 3 are circuit diagrams of the prior art bias stabilization circuits.

FIG. 1 is a circuit diagram of a voltage feedback bias stabilization circuit which stabilizes the drain current by a negative feedback of the output voltage to the input stage.

The gate voltage of the amplification transistor 101 is supplied by the drain voltage of the amplification transistor 101 divided by resistors 111 and 112. If the current tends to increase due to the characteristic variations of the amplification transistor 101, then voltage drop at the load resistor 121 increases. The output voltage thus drops resulting in decrease of voltage at the gate of the amplification transistor 101 which in turn decreases the drain current of the amplification transistor 101. As a result of these operations, the variation of the drain current is reduced. This type of stabilization has a drawback that the amplification gain is decreased because the bias circuit is connected in parallel with the load resistor.

FIG. 2 is a circuit diagram of a current feedback bias stabilization circuit which stabilizes the drain current by a negative feedback of the drain current variations of the amplification transistor 201 to the gate voltage. The gate voltage of the amplification transistor 201 is fixed to a certain voltage by divide resistors 211 and 212. If the current tends to increase due to the characteristic variations of the amplification transistor 201, then the voltage drop across the resistor 213 connected in series with the source increases. Thus the source voltage increases while the gate voltage is maintained constant. As a result, the gate-source voltage decreases to reduce the current. This has an effect of the reduction of the variations of the drain current. This kind of stabilization circuit has a drawback that, in order to prevent decrease of the amplification gain, a large capacitor 214 has to be connected to the source in parallel with the bias stabilization resistor 213, taking much area of the integrated circuit. Also, output power handling capacity is reduced because of the DC voltage drop at the bias stabilization resistor 213.

FIG. 3 is a circuit diagram of the current mirror type bias circuit which, unlike the above mentioned feedback circuits, has a bias circuit outside of the amplification circuit, from which the gate voltage of the amplification transistor is supplied. A resistor 342 for determining the current and the transistor 341 for reference voltage generation are connected to the power supply in series. The gate voltage of the reference voltage generation transistor 341 is then supplied to the gate of the amplification transistor 301. The drain current of the amplification transistor 301 can be easily determined by the ratio of gate width between the reference voltage generation transistor 341 and the amplification transistor 301. For this circuit to be operated properly, it is necessary that the drain-source voltage of the reference voltage generation transistor 341 should be higher than the saturation voltage (about 1 V). The circuit shown in FIG. 3, however, operates at the drain-source voltage of within 0.3 V and 0.4 V, so it has inferior stability to the variations of device parameters.

SUMMARY OF THE INVENTION

It is an object of the present invention to provide a bias stabilization circuit for minimizing the current variations of amplification transistors caused by variations of device parameters which occur during the manufacturing of high-frequency integrated circuits, and caused by variations of supply voltage and temperature.

The bias stabilization circuit according to the present invention comprises a gate voltage generation circuit using a reference voltage generation transistor to supply gate voltage to an amplification transistor, wherein the gate voltage generation circuit includes a level shifter circuit which is connected between the drain node and the gate node of the reference voltage generation transistor, and a constant current source using a depletion type transistor connected between the drain node of the reference voltage generation transistor and power supply, wherein a series resistor is connected between the source node and the gate node of the depletion type transistor.

BRIEF DESCRIPTION OF THE DRAWINGS

The objects, features and advantages of the present invention will be apparent to one skilled in the art from the following detailed description in conjunction with the accompanying drawings, in which.

Similar reference characters refer to similar parts in the several views of the drawings.

DETAILED DESCRIPTION

Figure 1:
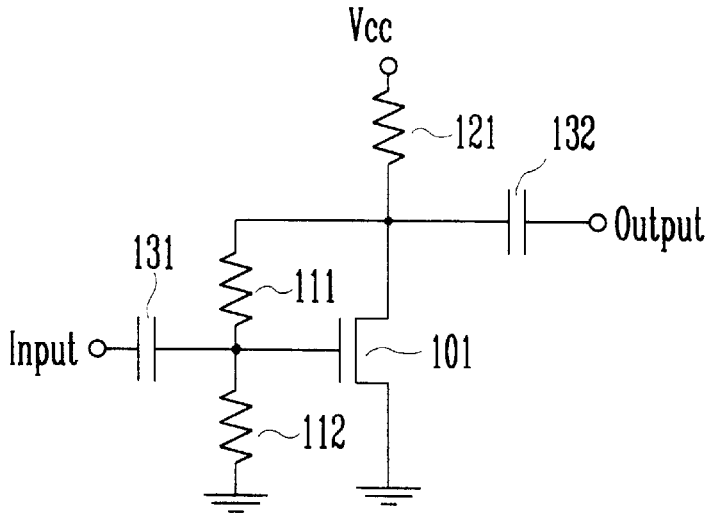
FIG. 1 through FIG. 3 are circuit diagrams of the prior art bias stabilization circuits.
Figure 2:
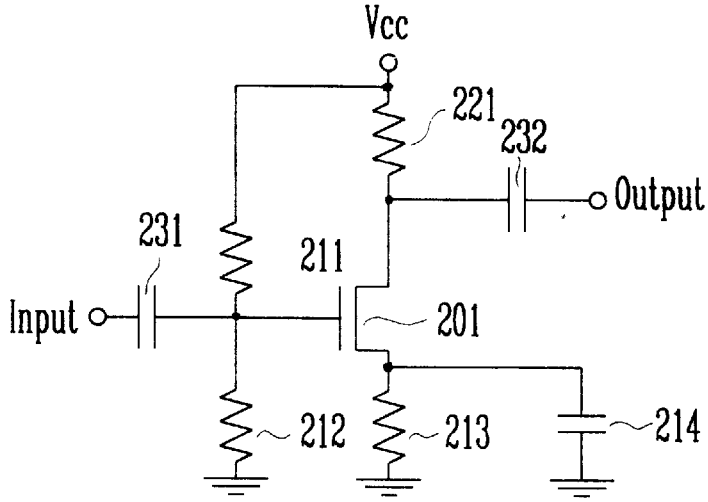

Now, a detailed description of the present invention follows referring to the attached figures.

The bias stabilization circuit according to the present invention is connected to the input of an amplification circuit. In a conventional amplification circuit, the amplification transistor 401 and a load resistor 421 are connected in series between a power supply Vcc and a ground. A coupling capacitor 432 is connected between the connection point of the load resistor 421 and transistor 401, and an output terminal Output. A coupling capacitor 431 is connected between the gate of transistor 401 and an input terminal Input.

The bias stabilization circuit 403 according to the present invention has an enhancement type reference voltage generation transistor 441 for generating a reference voltage having an amplification transistor 401, a constant current source 400 to flow a constant current via the transistor 441 and a level shift and feedback circuit 402 to shift voltage level of the constant current source 400 and supply to gates of the transistors 441 and 401.

That is, the constant current source 400 is connected between the supply voltage Vcc and a first connection node K1, in which the constant current source 400 has a depletion type transistor 443 and a resistor 442 connected in series thereto and the gate of the depletion type transistor 443 is connected to the node K1. The drain and source of the transistor 441 are connected between the first connection node K1 and a ground. The level shift and feedback circuit 402 is connected between the power supply Vcc and the ground and has a common drain transistor 444, resistors 445 and 446 which are connected to each other in series. A resistor 411 is connected between a second connection node K2, which is a connection node of the resistors 445 and 446, and the gate of the amplification transistor 401, wherein the second connection node K2 is connected to a gate of the transistor 441. Also, the gate of the common drain transistor 444 is connected to the first connection node K1 while a gate of the transistor 441 is connected to the second connection node K2.

The bias stabilization circuit is described as follows:

As current increases due to the characteristic variation of the transistor 401, current flowing through the transistor 441 having an identical characteristic with the transistor 401 increases. The potential of the first connection node K1 is lowered since the constant current source is constructed to flow a constant current when the voltage more than a saturation voltage, for example 0.8 volt, is applied between a drain and a source of the transistor 443. Therefore, the potential of the second connection node K2 is lowered by operation of the transistor 444 to which the voltage of the first connection node K1 is inputted, whereby current flowing through transistors 441 and 401 is decreased. That is, increase of current due to characteristic variation of the transistor 401 is prevented.

If the currents through the enhancement-type transistors 441 and 401 tend to be increased due to the variations of the characteristics, the drain voltage of the reference voltage generation transistor 441 goes down, and the gate voltage of the reference voltage generation transistor 441 goes down so that the drain current remains constant. At this time, not only the gate voltage of the reference voltage generation transistor 441 but also the gate voltage of the amplification transistor 401 decrease, thus the current through the amplification transistor 401 becomes stable.

Figure 3:
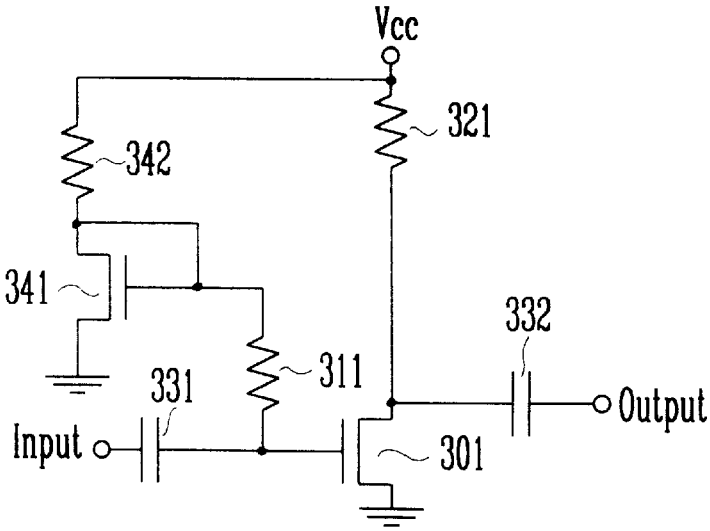
Figure 4:
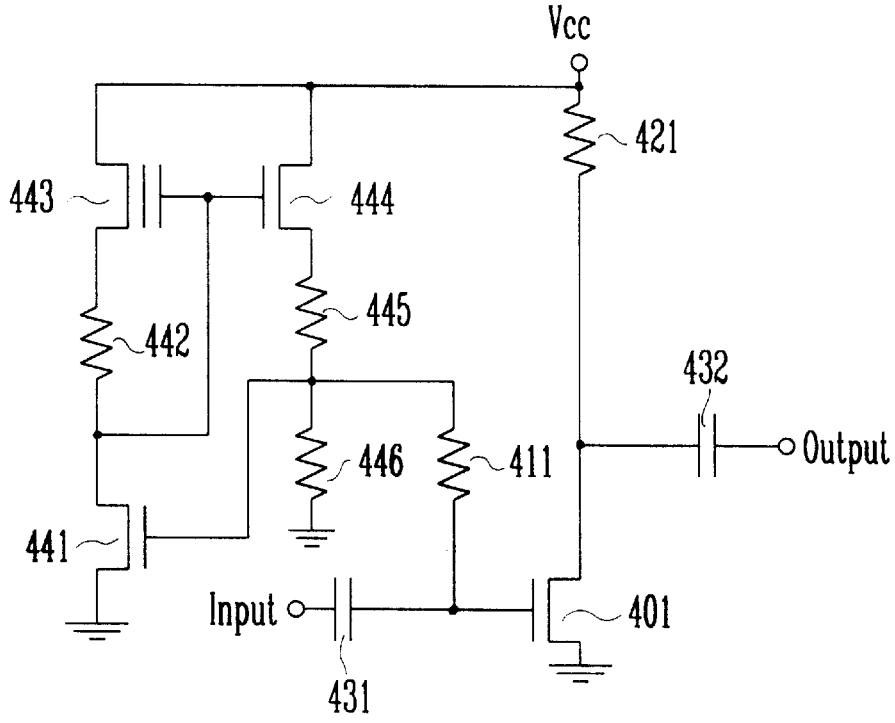
FIG. 4 is a circuit diagram of the bias stabilization circuit according to the present invention.

While the reference current varies according to the variations of the supply voltage in the prior art current reproduction type bias circuit shown in FIG. 3, in the circuit according to the present invention, a constant current can be achieved regardless of the variations of the supply voltage because the reference current is determined by the constant current source comprised of 443 and 442. Also, the prior art current mirror type bias circuit is operated in the linear region where characteristic variations due to the drain voltage are severe because the drain voltage of the reference voltage generation transistor 341 is low. Compared to this, as the drain voltage of the reference voltage generation transistor 441 is high, the circuit of the present invention is operated in the saturation region where current variations due to the variations of the drain voltage are low, reducing the current variations due to the variations of the supply voltage.

Figure 5:
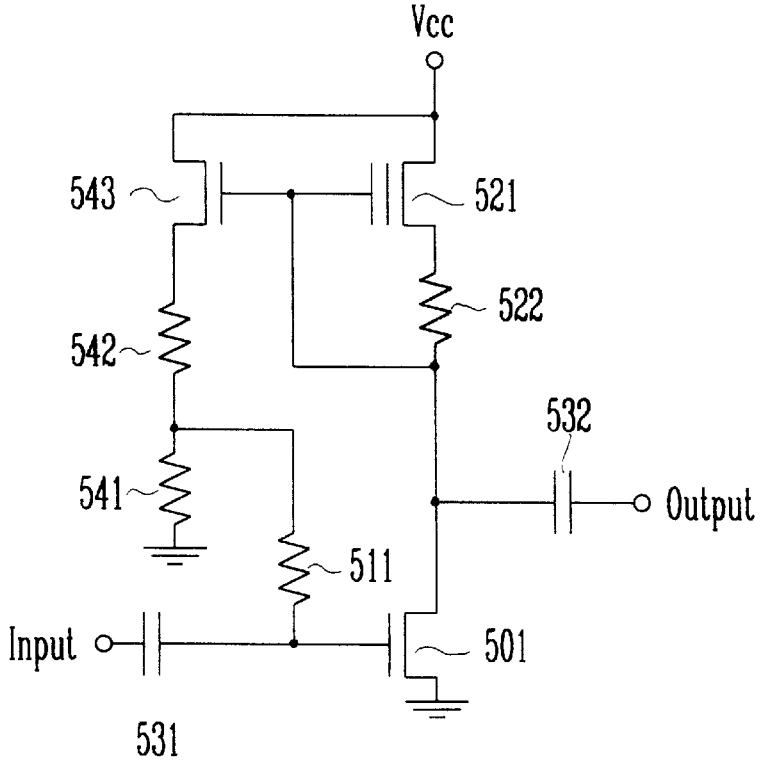
FIG. 5 is another embodiment of the bias stabilization circuit according to the present invention.

FIG. 5 is another embodiment of the bias stabilization circuit according to the present invention.

In the circuit of FIG. 5, the bias stabilization circuit itself is used as an amplification circuit. The bias stabilization operation is the same as the one we described above. But, in this circuit the output of the stabilization circuit is connected to the gate node of the reference voltage generation transistor 501 through a resistor 511 having high resistance. The input signal is also connected to the gate node of the reference voltage generation transistor 501 through a DC blocking capacitor 531. Hence both the bias stabilization and the amplification are performed at the same time.

As described above, according to the present invention, by stabilizing the drain current of the amplification transistor against the variations of the device parameters occurring during the manufacturing process, the throughput of the integrated circuit is enhanced. Also the variations of the characteristics due to the variations of the operating temperature can be minimized to get enhanced performance. Further, as this circuit has a stabilized current reproduction type bias structure, the circuit design is made easy.

What is claimed is:

1. A bias stabilization circuit for an amplification transistor comprising:

a constant current source comprising a first resistor and a depletion type transistor having a source, a gate, and a drain in which the drain of said depletion type transistor is connected to a supply voltage, said first resistor being connected between the source and the gate of said depletion type transistor;

a level shift and feedback circuit comprising a second resistor and a third resistor connected at a connection node, and a common drain transistor having a drain connected to the supply voltage, and a gate connected to the gate of said depletion type transistor, said second and third resistors being connected between a source of said common drain transistor and a ground;

a fourth resistor connected between the connection node of said second and third resistors and a gate of said amplification transistor; and a reference voltage generation transistor having a gate connected to the connection node of said second and third resistors, a drain connected to the gate of said depletion type transistor, and a source connected to the ground.

* * * * *